US007887347B2

(12) United States Patent
Matsumura et al.

(10) Patent No.: US 7,887,347 B2
(45) Date of Patent: Feb. 15, 2011

(54) LEVER ENGAGING TYPE CONNECTOR

(75) Inventors: Kaoru Matsumura, Makinohara (JP); Akihiro Tsuruta, Fujieda (JP); Kazuya Terao, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/705,703

(22) Filed: Feb. 15, 2010

(65) Prior Publication Data

US 2010/0210127 A1 Aug. 19, 2010

(30) Foreign Application Priority Data

Feb. 16, 2009 (JP) ..... 2009-032728

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 6,183,277 B1 2/2001 Okabe et al.
6,544,054 B2 * 4/2003 Ishikawa et al. ..... 439/157
7,281,933 B1 * 10/2007 Shigeta et al. ..... 439/157
2002/0064984 A1 * 5/2002 Ishikawa et al. ..... 439/157
2007/0167046 A1 * 7/2007 Shigeta et al. ..... 439/157
2009/0203240 A1 * 8/2009 Matsumura et al. ..... 439/153

FOREIGN PATENT DOCUMENTS

JP 2000-91026 A 3/2000

* cited by examiner

*Primary Examiner*—Gary F. Paumen
(74) *Attorney, Agent, or Firm*—Sughrue Mion, PLLC

(57) ABSTRACT

To enable a male connector and a female connector to be opposed to each other in parallel, at least when female terminals and male terminals of the respective connectors start to be connected, so that engagement of the male terminals with the female terminals can be smoothly and coaxially performed, without applying excessive stress to each other, a thick wall part 40 protruding toward an upper face of a male connector 2 is formed in a part of a lower face of a lever 1 opposed to the upper face of the male connector 2.

3 Claims, 15 Drawing Sheets

LEVER ENGAGING TYPE CONNECTOR

BACKGROUND OF THE INVENTION

1. Field of the Invention

The present invention relates to a lever engaging type connector in which a male connector is engaged with a female connector, by rotating a lever mounted on the male connector.

2. Description of the Related Art

Conventionally, for the purpose of engaging a male connector and a female connector respectively having multiple terminals with each other, a lever engaging type connector in which a lever is used to reduce an operating force for engagement has been employed (Reference should be made to Patent Document 1).

The lever engaging type connector as described above is shown in FIG. 18. A lever engaging type connector 100 as shown in FIG. 18 includes a male connector 121, a lever 122 of which a center part is rotatably attached to boss parts 127 on both side faces 125 of the male connector 121, and a female connector 123 having an engaging space into which the male connector 121 is inserted.

The lever 122 has a pair of side plates 128 adapted to be superposed on both the side faces 125 of the male connector 121, and an operating part 129 that interconnects other end parts of a pair of these side plates 128. Each of the side plates 128 has a hole for positioning the boss part 127 provided at its center part, a pivot projection 130 acting as a pivot, when the lever is rotated, and provided at its one end side, and a temporarily locking piece 138 provided at a lower end at the other end side. In an initial stage of engagement, this temporarily locking piece 138 is positioned more remote from the female connector 123 than a temporarily locking protuberance 137 which is protruded from the side face of the male connector 121, thereby to make the lever 122 unable to rotate toward the female connector 123.

The female connector 123 includes a female type connector housing 132 having the above-described engaging space. Inner walls of this connector housing 132 which define the engaging space are provided with pivot projection guiding grooves 134 extending from upper ends of the inner walls deep into the engaging space, and pivot projection receiving grooves 135 respectively continued from the pivot projection guiding grooves 134 and extending in a direction intersecting the pivot projection guiding grooves 134, and releasing plate parts 139.

The pivot projection receiving grooves 135 act as the grooves for positioning the pivot projections 130 when the lever 122 is rotated, and for utilizing the pivot projections 130 as the pivot of the lever 122.

As the male connector 121 is brought near the female connector 123, the releasing plate parts 139 enter inside the temporarily locking pieces 138 to flex the temporarily locking pieces 138 outward, thereby allowing the temporarily locking pieces 138 to overpass the temporarily locking protuberances 137 toward the female connector 123.

In the lever engaging type connector 100 as described above, the pivot projections 130 are passed through the pivot projection guiding grooves 134, and then, positioned inside the pivot projection receiving grooves 135. In this state, the operating part 129 is pressed toward the female connector 123 and the lever 122 is allowed to rotate, whereby the male connector 121 is pushed deep into the engaging space to be engaged with the female connector 123, by utilizing the pivot projections 130 as the pivot, and by utilizing the holes for positioning the boss parts 127 as a point of action. Moreover, when the pivot projections 130 are positioned in the pivot projection receiving grooves 135, the releasing plate parts 139 enter inside the temporarily locking pieces 138 thereby allowing the temporarily locking pieces 138 to overpass the temporarily locking protuberances 137 toward the female connector 123. In this manner, the unrotatable state of the lever 122 is released.

Patent Document 1: JP-A-2000-91026

In the conventional lever engaging type connector 100 as described above has the following problems to be solved.

Specifically, when the lever 122 is operated to rotate, after it has been released from the unrotatable state, the male connector 121 is inclined in such a manner that the operating part side of the connector 121 slightly floats up from the female connector 123. As the reason for this phenomenon, it is considered that with the rotation of the lever 122 caused by utilizing the aforesaid pivot projections 130 as the pivot and the aforesaid holes for positioning the boss parts 127 as the point of action, an external force in a vertical direction to be directed to the female connector 123 is not exerted on the male connector 121, but an external force in a direction deviated from the vertical direction, which is perpendicular to a line segment interconnecting the pivot and the point of action, is exerted on the male connector 121. As the results, the male connector 121 cannot be rapidly positioned in parallel with the female connector 123, even in the final stage of the rotating operation of the lever 122. Therefore, female terminals and male terminals of the respective connectors 121, 123 will not be engaged with each other in a coaxial direction, but will be gradually engaged in an intersecting direction at the beginning, and later, in the coaxial direction with a large frictional resistance. Consequently, smooth engagement between the female terminals and the male terminals is not performed, and the rotating operation of the lever 122 becomes heavy, incurring abrasion of the terminals. Moreover, because the operating part side (the opposite side to the side of the pivot projection 130) of the male connector 121 floats up from the female connector 123 as described above, an engaging amount of the male terminals with respect to the female terminals is small at the operating part side, while the engaging amount is large at the pivot projection side. In short, there has been such inconvenience that a depth of contact between a pair of the terminals is different between the operating part side and the pivot projection side, and hence, the rotating operation becomes further heavy.

Moreover, there has been such inconvenience that even after the rotation of the lever 122 has been completed, and connection (engagement) between the female connector 123 and the male connector 121 has been achieved, a backlash may occur between the male connector 121 and the lever 122, due to a clearance which is required for positioning the pivot projections 130 of the lever 122 with respect to the pivot projection receiving grooves 135 of the female connector 123, and besides, a clearance which is required for assembling the male connector 121, the lever 122 and the female connector 123.

SUMMARY OF THE INVENTION

The invention has been made in view of the above described circumstances, and it is an object of the invention to provide a lever engaging type connector, in which in case of connecting a male connector to a female connector by operating a lever, an inclination of the male connector is corrected, by moving a pivot of the lever little by little so that the inclined male connector may be made parallel to the female connector, whereby the male and female connectors can be opposed to each other in parallel, at least at initiation of connection between female terminals and male terminals of the respective connectors, so that engagement of the male terminals with the female terminals can be coaxially and smoothly performed, without applying excessive stress to the terminals, and further, occurrence of a backlash between the male connector and the lever can be prevented, after the connection (engagement) between the female connector and the male connector has been completed.

In order to attain the above-described object, the lever engaging type connector according to the invention has the features as describe below in (1) to (3).

(1) A lever engaging type connector, comprising a male connector, a lever whose center part is rotatably attached to boss parts on both side faces of the male connector, a female connector having an engaging space into which the male connector is inserted, and a pivot projection being provided at one end side of the lever; wherein the lever is rotated by pressing the other end side of the lever toward the female connector, in a state where the pivot projection is positioned in a pivot projection receiving groove which is provided on an inner wall defining the engaging space, thereby enabling the pivot projection to act as a pivot, and the center part to act as a point of action, whereby the male connector is pushed deep into the engaging space along an engaging direction allowing the male connector to be engaged with the female connector; wherein the pivot projection containing groove is composed of a groove which is continued from an end of a pivot projection guiding groove extending from an upper end of the inner wall deep into the engaging space along the engaging direction, which is remote from the upper end, and extends in a direction intersecting the engaging direction; the lever and the male connector are provided with temporarily locking means for making the lever unrotatable toward the female connector in an initial stage of engagement; the inner wall is provided with a releasing plate part in a plate-like shape for releasing an unrotatable state of the lever by the temporarily locking means, as the male connector approaches the female connector, the pivot projection is positioned in the pivot projection receiving groove at a time point when the unrotatable state of the lever has been released, and a thick wall part protruding toward an upper face of the male connector is formed in a part of a lower face of the lever opposed to the upper face of the male connector.

(2) The lever engaging type connector as claimed in (1), wherein the thick wall part is formed at the other end side of the lower face of the lever opposed to the upper face of the male connector.

(3) The lever engaging type connector as claimed in claim (1), wherein the thick wall part has such a thickness that a lower face of the thick wall part can be contacted with the upper face of the male connector, before the terminals formed in the male connector are electrically connected to the terminals formed in the female connector by pushing operation of the male connector caused by the rotation of the lever.

According to the structure as described above in (1), in case where the lever is not operated to rotate, and the male connector having the boss part rotatably held in the hole of the lever is inserted into the female connector, while the pivot projection of the lever is guided into the pivot projection guiding groove in the female connector, the male connector will float up with respect to the female connector. On the other hand, the pivot projection of the lever is positioned in the pivot projection receiving groove, after the unrotatable state of the lever by the temporarily locking means has been released, and therefore, when the lever is operated to rotate around the pivot projection as the pivot, the thick wall part presses the operation part side of the male connector. As the results, an inclination of the lever is changed little by little around the pivot projection, and an inclination of the male connector is corrected gradually in the rotating process of the lever or before and after completion of the rotation, whereby the lever allows the male connector to be opposed to the female connector substantially in parallel. In this manner, the terminals of the respective connectors are smoothly and coaxially engaged with each other in the rotating process of the lever or before and after the completion of the rotation, and the optimal engaged state can be obtained without exerting an excessive stress on each other. Moreover, the thick wall part depresses occurrence of a backlash due to clearances of various kinds between the lever and the male connector, including a clearance required for the pivot projection moving in the pivot projection receiving groove, and hence, smooth engagement between the terminals by the correction of the inclination of the male connector can be achieved.

According to the structure as described above in (2), when the lever is operated to rotate around the pivot projection as the pivot, the thick wall part presses the operating part side of the male connector. As the results, the inclination of the lever is changed little by little around the pivot projection, and the inclination of the male connector is corrected in the rotating process of the lever or especially after the completion of the rotation, whereby the male connector and the female connector can be opposed to each other so as to be substantially in parallel.

According to the structure as described above in (3), the terminals of the respective connectors have been already coaxially positioned, before the terminals are engaged with each other, and hence, these terminals can be reliably and smoothly engaged with each other.

According to the invention, in case of coupling the male connector to the female connector by operating the lever, the male connector can be opposed to the female connector in parallel with each other, at least at the initiation of the engagement between the female terminals and the male terminals of the respective connectors, and hence, the engagement between the female terminals and the male terminals can be performed smoothly and coaxially, without applying excessive stress to the terminals. Moreover, after the male connector and the female connector have been coupled to each other, the respective terminals are tightly and coaxially engaged with each other, and occurrence of a backlash or unstable electrical connection between the terminals can be prevented beforehand.

DESCRIPTION OF THE PREFERRED EMBODIMENTS

Now, a lever engaging type connector 10 in an embodiment according to the invention will be described referring to FIGS. 1 to 17.

Figure 1:
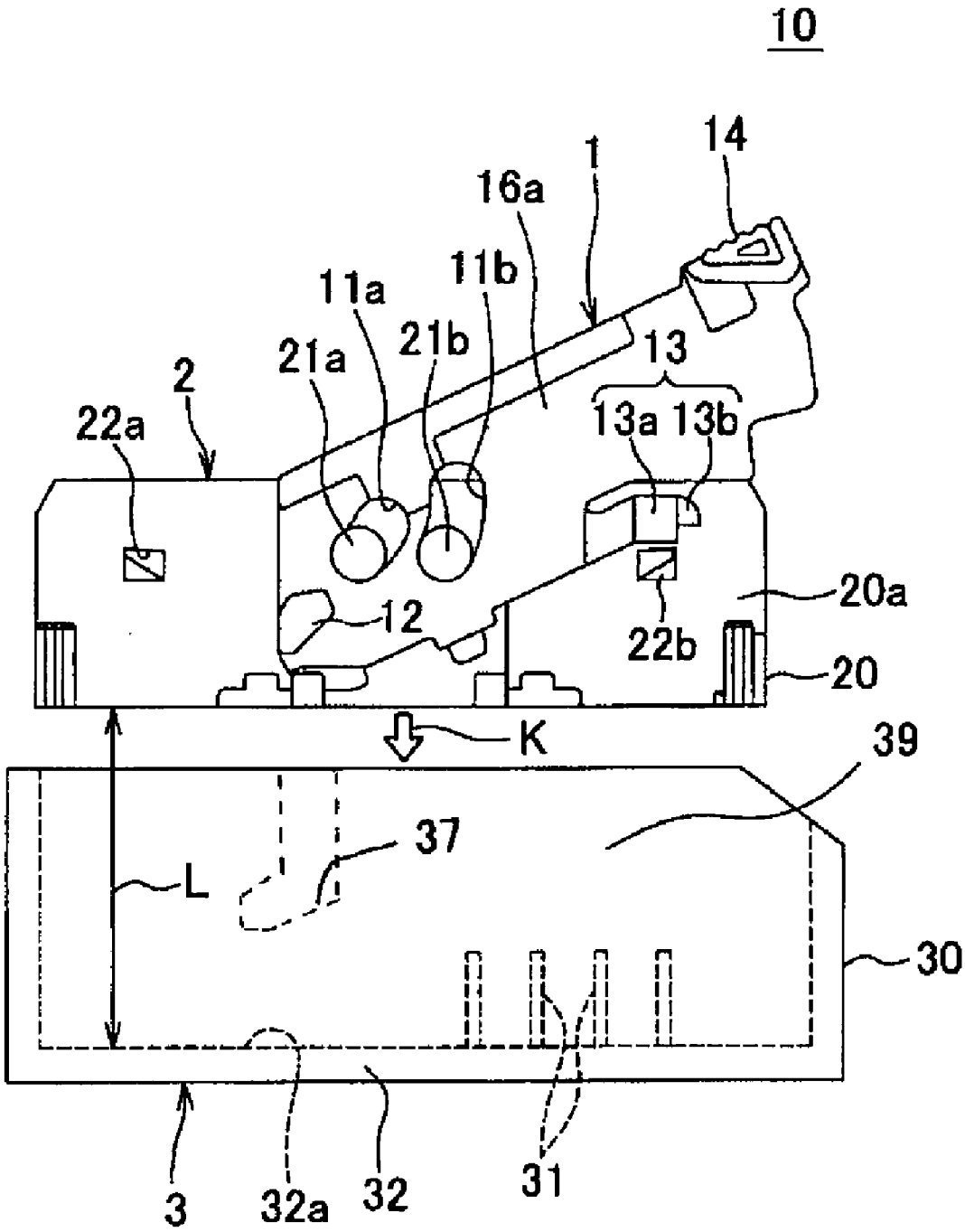
FIG. 1 is a plan view showing a lever engaging type connector in an embodiment according to the invention.

The lever engaging type connector 10 in the embodiment as shown in FIG. 1 includes a male type connector (hereinafter referred to as "the male connector") 2, a lever 1 which is rotatably provided on a connector housing 20 of this male connector 2, and a female type connector (hereinafter referred to as "the female connector") 3 which has a connector housing 30 having an engaging space 39 into which the male connector 2 is inserted. By rotating the lever 1, the male connector 2 is pushed deep into the engaging space 39 along an engaging direction K thereby to be engaged with the female connector 3.

Figure 2:
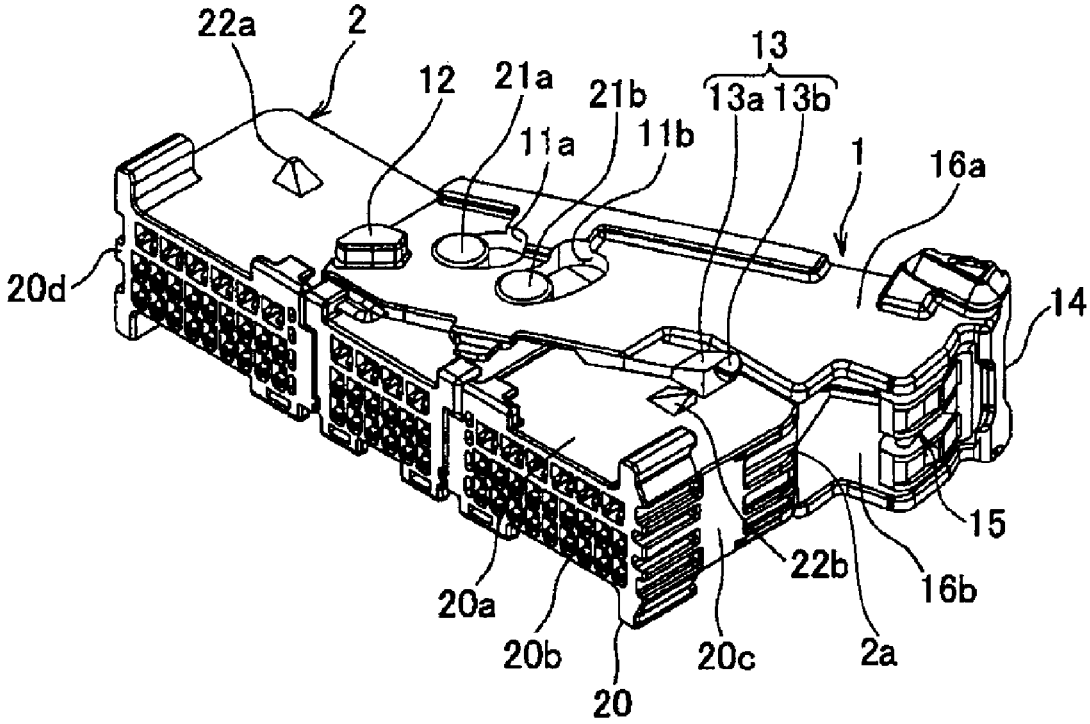
FIG. 2 is a perspective view showing a male connector and a lever in the lever engaging type connector as shown in FIG. 1.
Figure 14A:
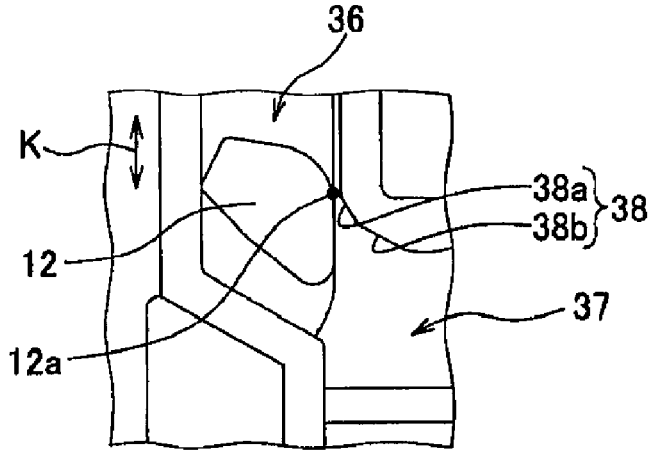
FIG. 14A is an enlarged view of a pivot projection in the lever engaging type connector as shown in FIG. 9.
Figure 14B:
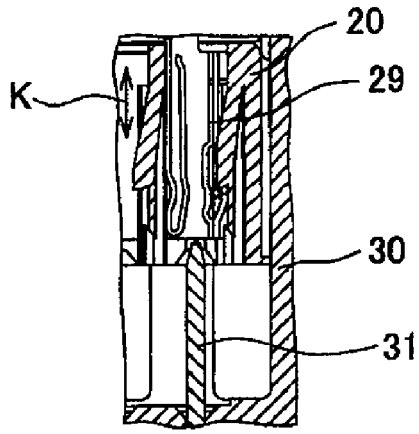
FIG. 14B is a sectional view showing positional relation between terminals in the lever engaging type connector as shown in FIG. 14A.

As shown in FIGS. 1 and 2, the male connector 2 includes the connector housing 20 formed of insulating synthetic resin in a rectangular shape, and terminals (female terminals) 29 which are contained in this connector housing 20 (See FIG. 14B). The connector housing 20 has side faces 20*a*, 20*b* which are opposed to each other, and connecting faces 20*c*, 20*d* respectively connecting both end parts of these side faces 20*a*, 20*b* to each other. Moreover, boss parts 21*a*, 21*b* in a columnar shape are provided interposing an interval between them in respective center parts of the side faces 20*a*, 20*b* in a longitudinal direction. It is to be noted that the longitudinal direction is a direction perpendicular to the engaging direction K as shown in FIG. 1. Further, temporarily locking protuberances 22*a*, 22*b* in a trapezoidal shape are provided in both end parts of the side faces 20*a*, 20*b* so as to protrude from surfaces of the side faces 20*a*, 20*b*.

Figure 3:
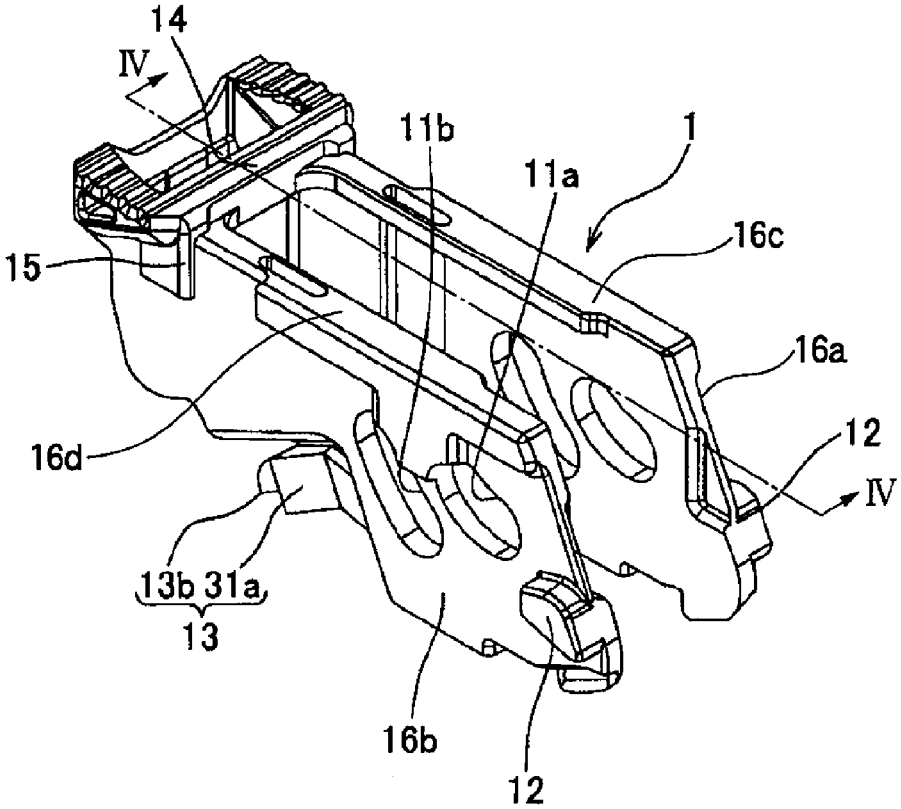
FIG. 3 is a perspective view showing the lever in the lever engaging type connector as shown in FIG. 1.

The lever 1 is formed of insulating synthetic resin, and includes, as shown in FIGS. 1 to 3, a pair of side plates 16*a*, 16*b* which are arranged in parallel with each other, and separated from each other at their one end parts interposing a space, and an operating part 14 which interconnects the other end parts of these side plates 16*a*, 16*b*. This operating part 14 is a portion to which a load is applied when the lever 1 is rotated, that is, a point of force of the lever 1. Moreover, the operating part 14 is provided with lock arms 15 to be locked to the connector housing 30 of the female connector 3, in a state where the male connector 2 is engaged with the female connector 3. By locking these lock arms 15 to the connector housing 30, the male connector 2 can be prevented from moving in a direction away from the female connector 3, when an unexpected external force is exerted on the lever 1.

A pair of the side plates 16*a*, 16*b* are respectively provided with pivot projections 12, at respective one ends thereof. When these pivot projections 12 are positioned inside pivot projection receiving grooves 37 which are provided in the connector housing 30 of the female connector 3, the pivot projections 12 will be caught by the connector housing 30 and act as the pivot of the lever 1. Moreover, a pair of boss part receiving holes 11*a*, 11*b* for respectively positioning the above described boss parts 21*a*, 21*b* are formed at positions more close to the other end than the pivot projections 12. The boss part receiving holes 11*a*, 11*b* act as a point of action of the lever 1 with respect to the connector housing 20.

A pair of the side plates 16*a*, 16*b* are respectively provided with temporarily locking pieces 13 at their lower ends close to the other ends. When these temporarily locking pieces 13 are positioned at positions more remote from the female connector 3 than either of the temporarily locking protuberances 22*a*, 22*b* in the initial stage of the engagement between the connectors 2 and 3, the lever 1 becomes unable to rotate toward the female connector 3. The temporarily locking pieces 13 respectively include butting protuberances 13*a* having end faces to be butted against the temporarily locking protuberances 22*b*, and flexible pieces 13*b* continued from the butting protuberances 13*a* and extending to the other end side of the side plates 16*a*, 16*b*. The flexible pieces 13*b* are formed so as to be easily flexed, having a smaller wall thickness than the butting protuberances 13*a*. Moreover, the flexible pieces 13*b* extend outward along a direction in which the side plates 16*a*, 16*b* are opposed to each other.

Figure 4:
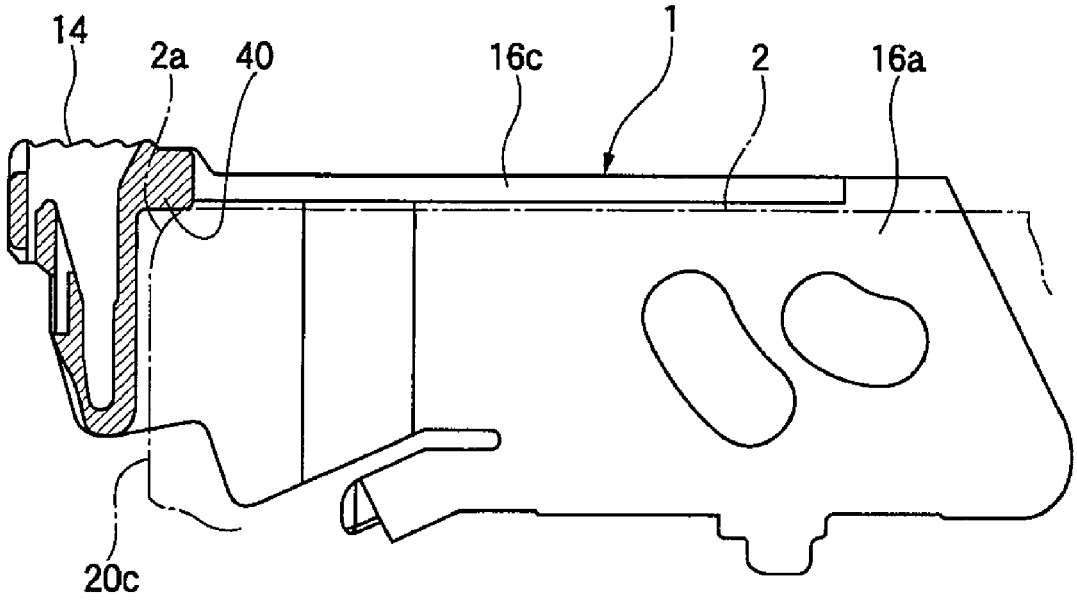
FIG. 4 is a sectional view showing the lever, taken along a line IV-IV in FIG. 3.
Figure 5:
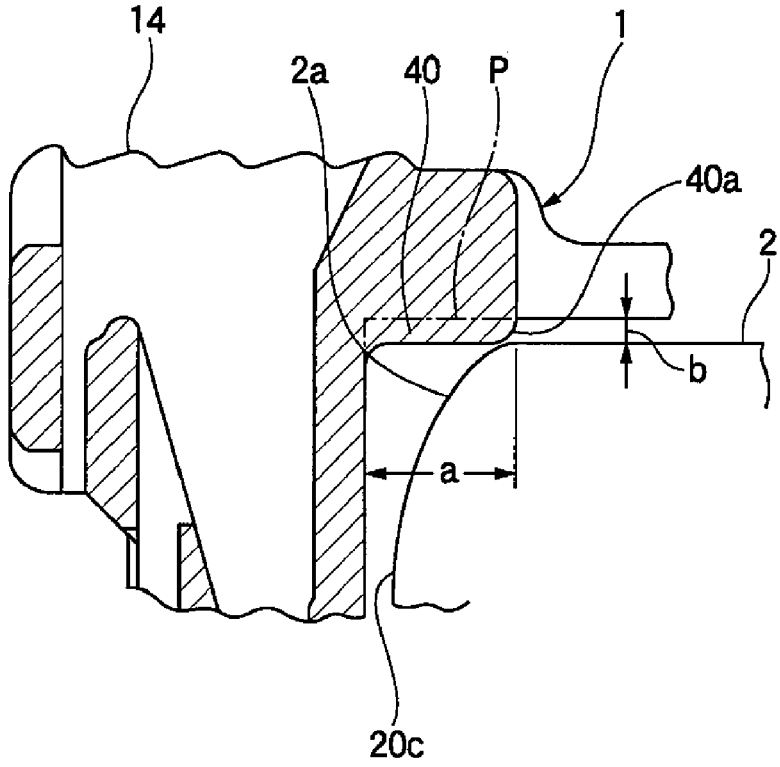
FIG. 5 is an enlarged sectional view showing an essential part of the lever as shown in FIG. 4.

FIGS. 4 and 5 show in section a structure of the lever 1. FIG. 4 is a sectional view of the lever 1 taken along a line IV-IV in FIG. 3, and FIG. 5 is an enlarged sectional view showing an essential part of the lever 1 as shown in FIG. 4. This lever 1 has a thick wall part (a heaped up part) 40 which is integrally provided in a lower part of the operating part 14 interconnecting the side plates 16*a*, 16*b* and on a lower face to be opposed to an upper face of the connector housing 20 of the male connector 2, so as to protrude toward the upper face of the connector housing 20.

This thick wall part 40 has a larger thickness than a thickness of projected edges 16*c*, 16*d* for reinforcement which are continuously formed at upper ends of the side plates 16*a*, 16*b*, and a lower face of the thick wall part 40 is positioned below lower faces of the projected edges 16*c*, 16*d* (in a direction toward the connector housing 20). In this manner, the thick wall part 40 is formed as a heated up part projecting toward the upper face of the connector housing 20. The projected edges 16*c*, 16*d* are opposed to and in parallel with each other. In FIG. 5, the thick wall part 40 is shown by a chain line P, and has a width a and a thickness b. Moreover, a corner part 40*a* of the thick wall part 40 is chamfered, or cut in an arc-like shape so as to be smoothly contacted with and separated from an arc-shaped face 2*a* of the male connector 2 in a corner part at an upper end thereof.

Figure 6:
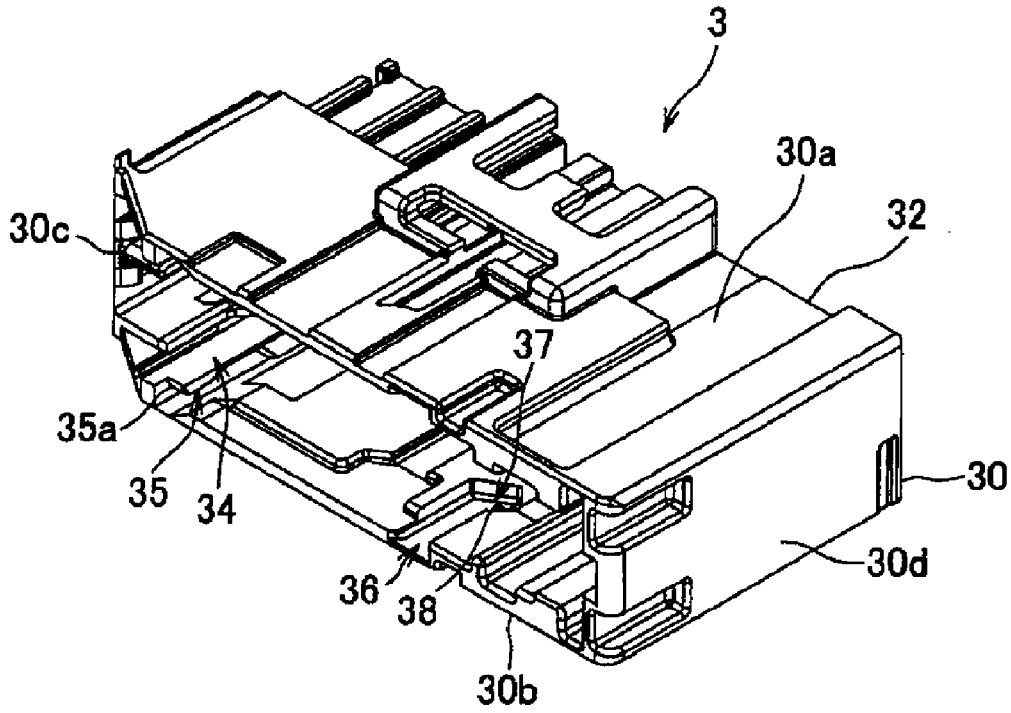
FIG. 6 is a perspective view showing a female connector of the lever engaging type connector as shown in FIG. 1.

As shown in FIGS. 1 and 6, the female connector 3 is formed of insulating synthetic resin, and includes the female connector housing 30 having the aforesaid engaging space 39, and terminals (male terminals) 31 which are contained in this connector housing 30. These male terminals 31 are adapted to be engaged with the terminals (the female terminals) 29 of the male connector 2.

The connector housing 30 includes side faces 30*a*, 30*b* which are opposed to each other, connecting faces 30*c*, 30*d* respectively interconnecting both ends of these side faces 30*a*, 30*b* to each other, and a bottom face 32 for supporting the terminals 31 which is provided at an opposite side to an opening of the engaging space 39. These side faces 30*a*, 30*b*, the connecting faces 30*c*, 30*d*, and the bottom face 32 define the engaging space 39. Inner faces of the side faces 30*a*, 30*b* (the inner walls in the claims) are respectively provided with pivot projection guiding grooves 36 which extend from upper ends of the inner faces (the ends at a side remote from the bottom face 32) deep into the engaging space 39 along the engaging direction K, pivot projection receiving grooves 37 which are continued from ends of the pivot projection guiding grooves 36 remote from the upper ends and extend in a direction intersecting the pivot projection guiding grooves 36, and releasing plate parts 35 in a plate-like shape.

The pivot projection receiving grooves 37 are the grooves for positioning the pivot projections 12 when the lever 1 is rotated, and for utilizing these pivot projections 12 as the pivot of the lever 1. Each of these pivot projection receiving grooves 37 is provided with an edge wall 38 which is adapted to be contacted with an outer edge of the pivot projection 12, as shown in FIGS. 14 to 17. The edge wall 38 includes a first taper wall 38*b*, and a second taper wall 38*a* for guiding the pivot projection 12 to the first taper wall 38*b*. The first taper wall 38*b* is inclined so that a width of the pivot projection receiving groove 37 may be made smaller as it goes away from the pivot projection guiding groove 36. The second taper wall 38*a* is inclined so that the width of the pivot projection receiving groove 37 may be made larger as it extends from the first taper wall 38*b* to the pivot projection guiding groove 36. The pivot projection guiding groove 36 is a guide groove through which the pivot projection 12 is passed, until it is positioned inside the pivot projection receiving groove 37.

Because the second taper wall 38*a* as described above is provided, according to the invention, the second taper wall 38*a* can catch the pivot projection 12 to guide it to the first taper wall 38*b*, even in case where the unrotatable state of the lever 1 has been released earlier than expected. Therefore, the pivot projection 12 can be positioned inside the pivot projection receiving groove 37 without fail, at a time point when the unrotatable state of the lever 1 has been released.

Figure 7:
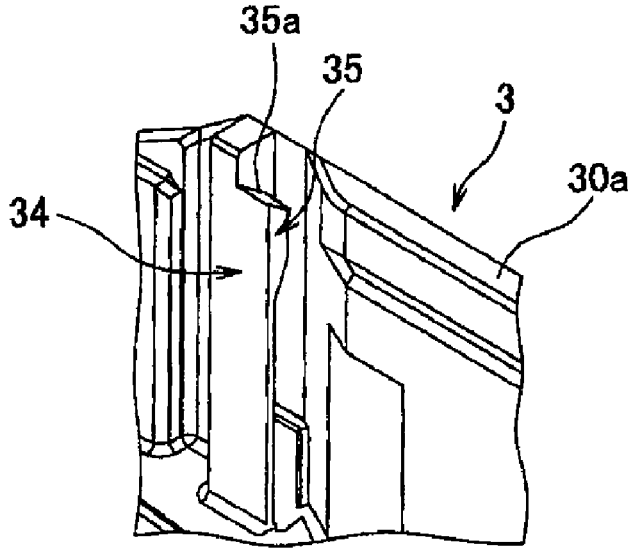
FIG. 7 is a perspective view showing an interior of a housing of the female connector as shown in FIG. 6.

The releasing plate part 35 enters inside the flexible piece 13*b* of the temporarily locking piece 13, as the male connector 2 approaches the female connector 3, and allows the flexible piece 13*b* to be flexed outward in the direction in which the side plates 16*a*, 16*b* are opposed to each other, thereby permitting the butting protuberance 13*a* to overpass the temporarily locking protuberance 22*b* toward the female connector 3. As shown in FIG. 6, the releasing plate part 35 is integrally provided on an opposed wall 34 which is provided so as to be opposed to the inner face of each of the side faces 30*a*, 30*b*. Moreover, as shown in FIG. 7, the releasing plate part 35 is provided with a taper portion 35*a* at an upper end thereof, which has a thickness gradually increased, as it goes deep into the engaging space 39 along the engaging direction K.

Figure 18:
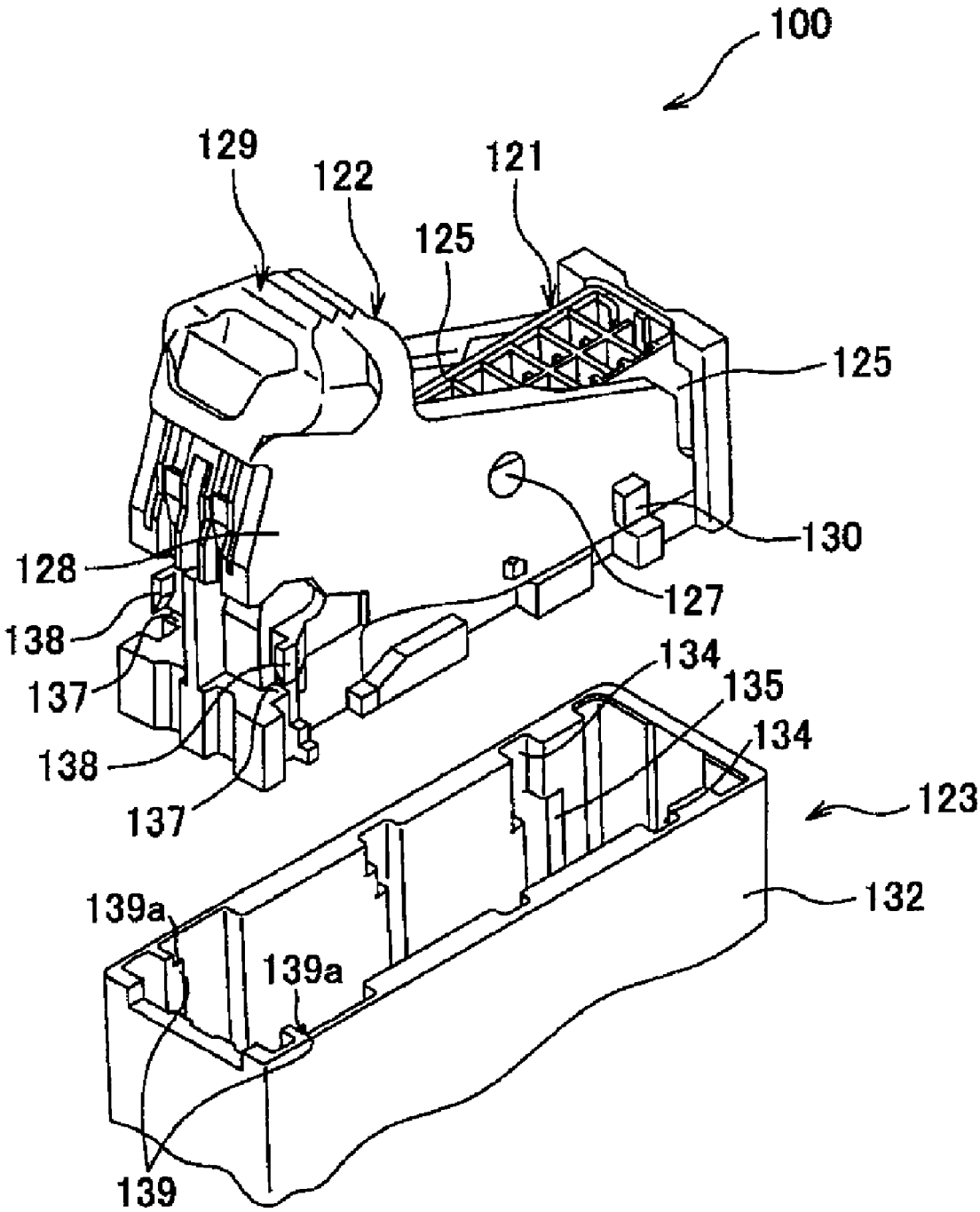
FIG. 18 is a perspective view showing a conventional lever engaging type connector.

The taper portion 35*a* is preferably formed at an angle of 60 to 90-degree ($\tan^{-1}\times$ coefficient of friction $\mu$), and is formed at 60 degree, in this embodiment. For information, the conventional taper portion (See the taper portion 139*a* in FIG. 18) is formed at a smaller angle than 60 degree. Because the taper portion 35*a* is formed at the larger angle than the conventional taper portion, a lever operating stroke when the flexible piece 13*b* overpasses the taper portion 35*a* becomes smaller than in the conventional case. For this reason, even though a manner of applying a force to the operating part 14 is varied, deviation is unlikely to occur in a timing where the unrotatable state of the lever 1 is released. As the results, at the time point when the unrotatable state of the lever 1 has been released, the pivot projection 12 can be positioned, without fail, inside the pivot projection receiving groove 37.

Further, a locking force (a temporary lock holding force) of the butting protuberance 13*a* with respect to the temporarily locking protuberance 22*b* for maintaining the lever 1 in the unrotatable state, that is, uneasiness that the butting protuberance 13*a* is detached from the temporarily locking protuberance 22*b* is determined, depending on a locking amount of the flexible piece 13*b* with respect to the taper portion 35*a*. When the flexible piece 13*b* has completely overpassed the taper portion 35*a*, the locking force becomes zero. This means that the unrotatable state of the lever 1 has been released.

Figure 8A:
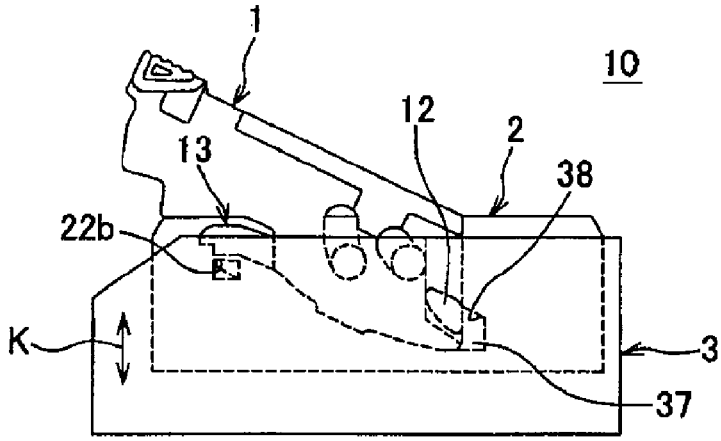
FIG. 8A is a plan view showing an initial state of engagement of the lever engaging type connector as shown in FIG. 1.
Figure 8B:
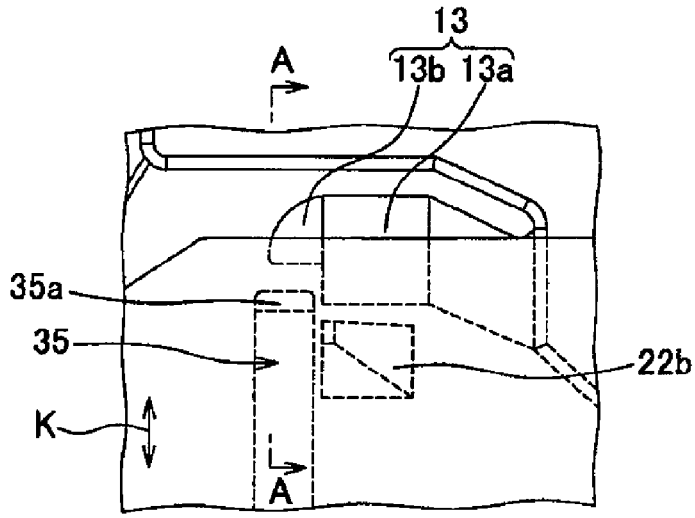
FIG. 8B is an enlarged view of a temporarily locking piece of the lever engaging type connector as shown in FIG. 8A.
Figure 8C:
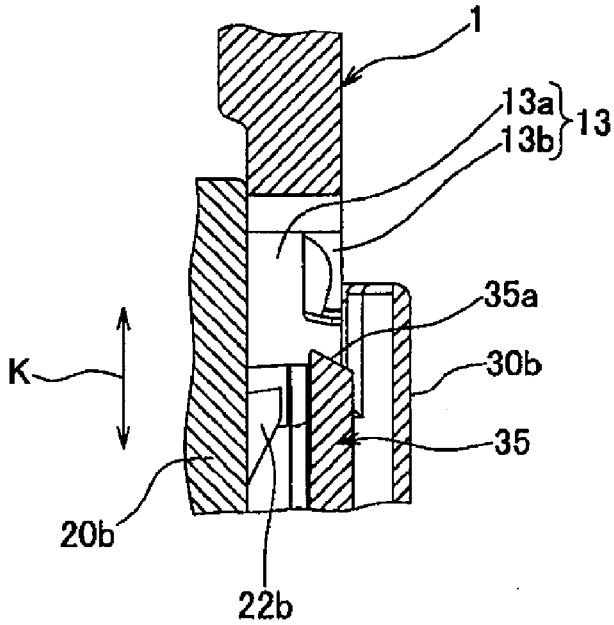
FIG. 8C is a sectional view taken along a line A-A in FIG. 8B.

In the above described lever engaging type connector 10, the lever 1 is mounted on the male connector 2, and in a state where the lever 1 is maintained in the unrotatable state (See FIGS. 8A, 8B and 8C), the male connector 2 is inserted into the engaging space 39 in the connector housing 30 of the female connector 3 (See FIG. 8A).

Figure 9A:
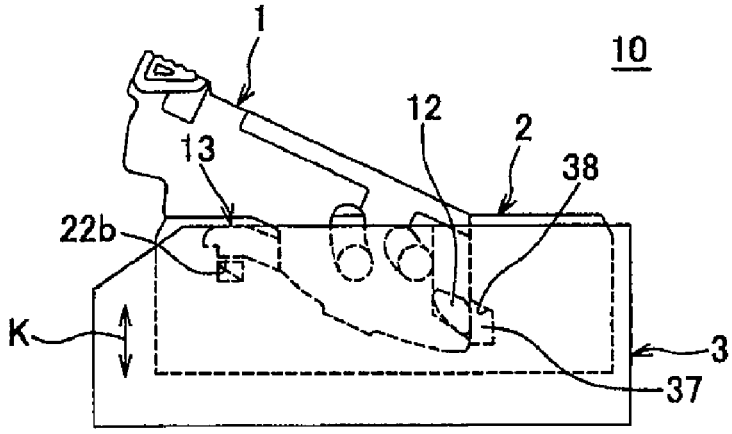
FIG. 9A is a plan view showing a state where the male connector has been further deep into the female connector in the lever engaging type connector as shown in FIG. 8.
Figure 9B:
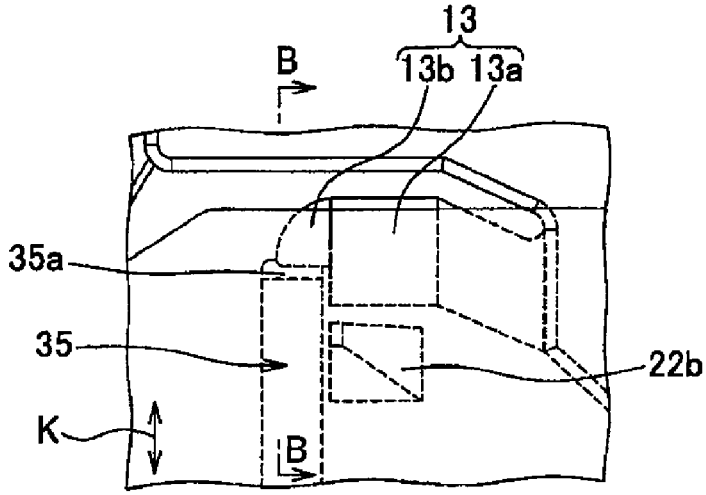
FIG. 9B is an enlarged view of the temporarily locking piece of the lever engaging type connector as shown in FIG. 9A.
Figure 9C:
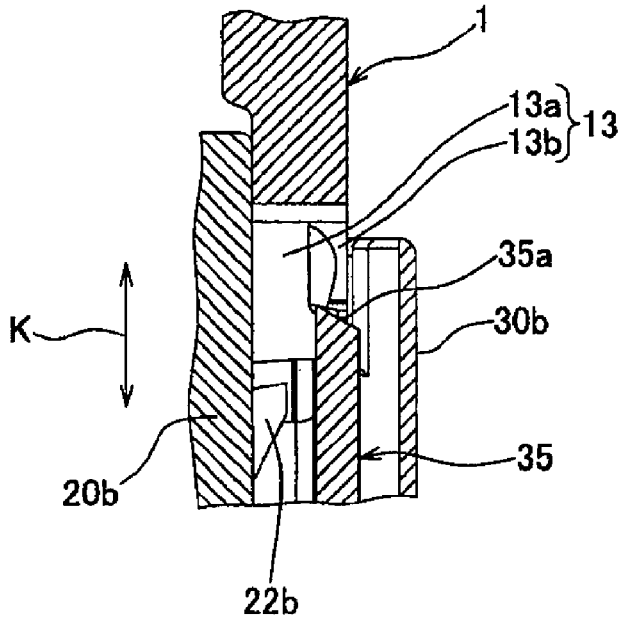
FIG. 9C is a sectional view taken along a line B-B in FIG. 9B.
Figure 14C:
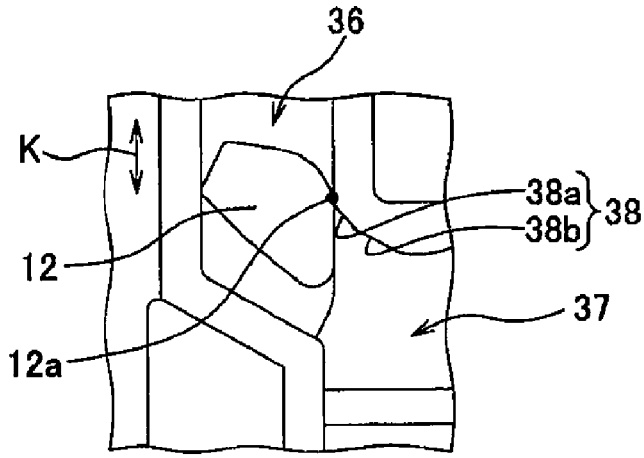
FIG. 14C is an explanatory view for explaining the position of the pivot projection when the unrotatable state of the lever has been released in the lever engaging type connector as shown in FIG. 14A.

When the male connector 2 has been inserted up to such a position that it can be inserted by its self weight, as shown in FIG. 9A, the upper end of the taper portion 35*a* of the releasing plate part 35 enters inside the flexible piece 13*b*, as shown in FIGS. 9*b* and 9C. In this state, the outer edge part 12*a* of the pivot projection 12 positioned most close to the one end side of the lever 1 is positioned above the second taper wall 38*a* in the engaging direction K, as shown in FIG. 14A. In short, the pivot projection 12 is positioned in the pivot projection guiding groove 36. Moreover, the terminals 29 and 31 are not electrically connected to each other, as shown in FIG. 14B. In case where the lever 1 is released from the unrotatable state and rotated in this state, the pivot projection 12 will not be pulled into the pivot projection receiving groove 37, as shown in FIG. 14 C, and the lever 1 will be idly rotated.

Figure 10A:
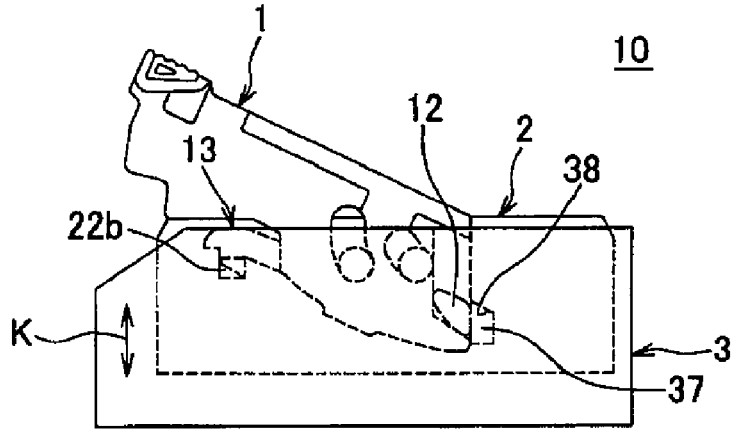
FIG. 10A is a plan view showing a state where the male connector has been pressed against the female connector in the lever engaging type connector as shown in FIG. 9.
Figure 10B:
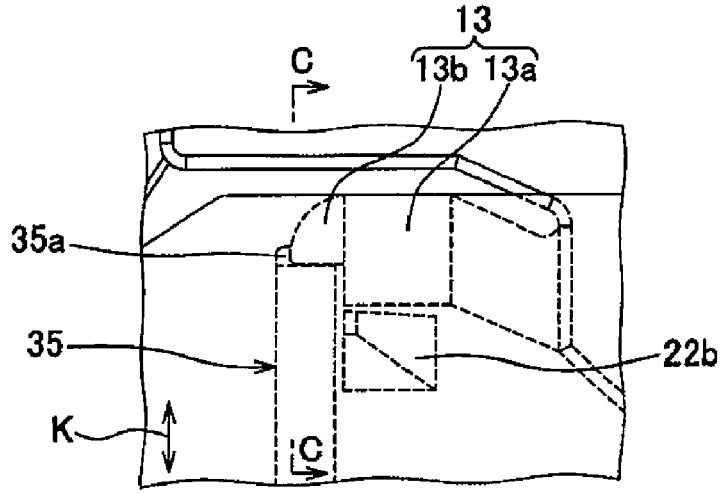
FIG. 10B is an enlarged view of the temporarily locking piece of the lever engaging type connector as shown in FIG. 10A.
Figure 10C:
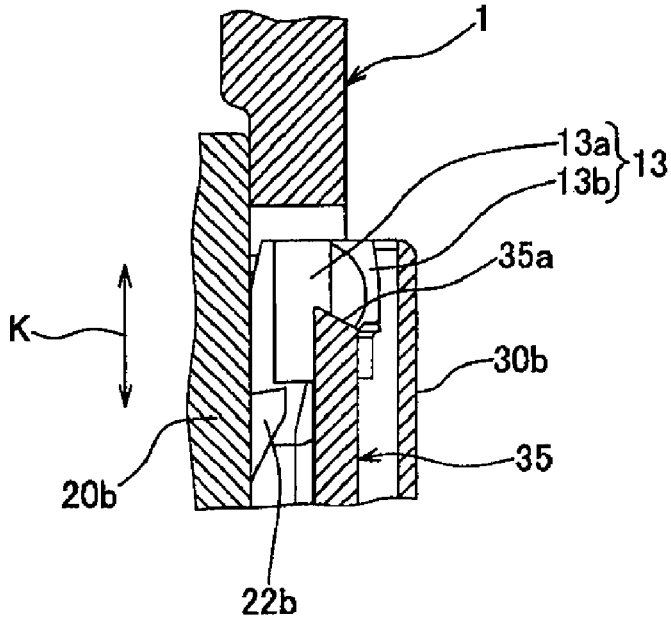
FIG. 10C is a sectional view taken along a line C-C in FIG. 10B.

Then, the operating part 14 of the lever engaging type connector 10 is pressed toward the female connector 3, as shown in FIG. 10A, and the taper portion 35*a* further enters inside the flexible piece 13*b* thereby allowing the flexible piece 13*b* to be flexed outward.

Figure 11A:
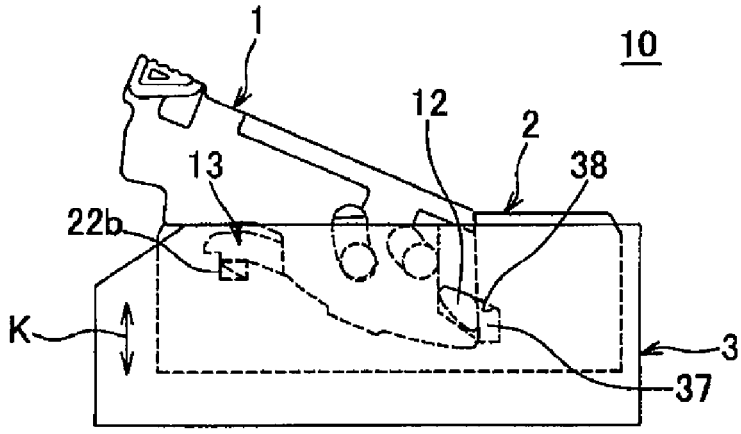
FIG. 11A is a plan view showing a state where an unrotatable state of the lever has been released in the lever engaging type connector as shown in FIG. 10.
Figure 11B:
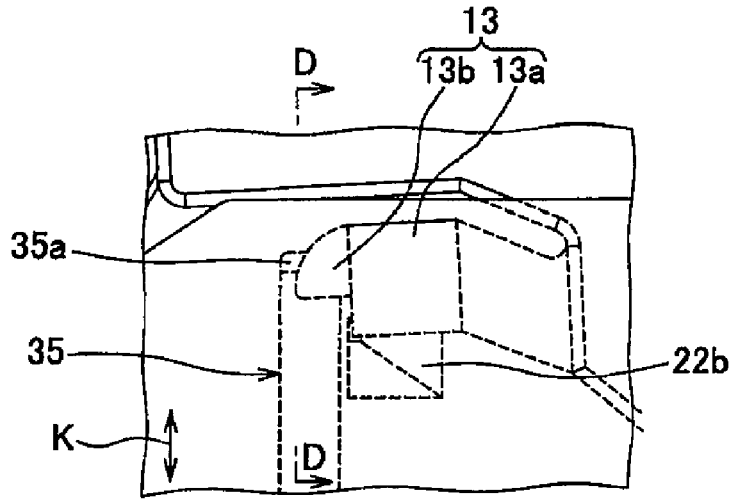
FIG. 11B is an enlarged view of the temporarily locking piece of the lever engaging type connector as shown in FIG. 11A.
Figure 11C:
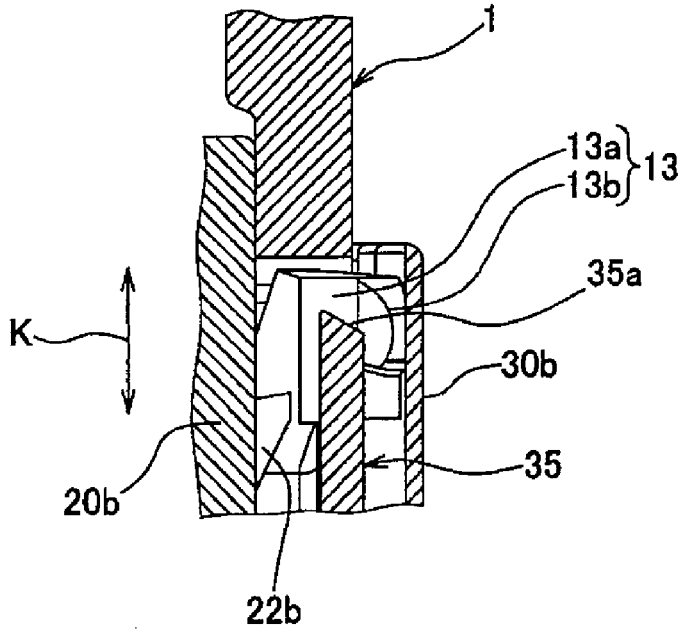
FIG. 11C is a sectional view taken along a line D-D in FIG. 11B.
Figure 15A:
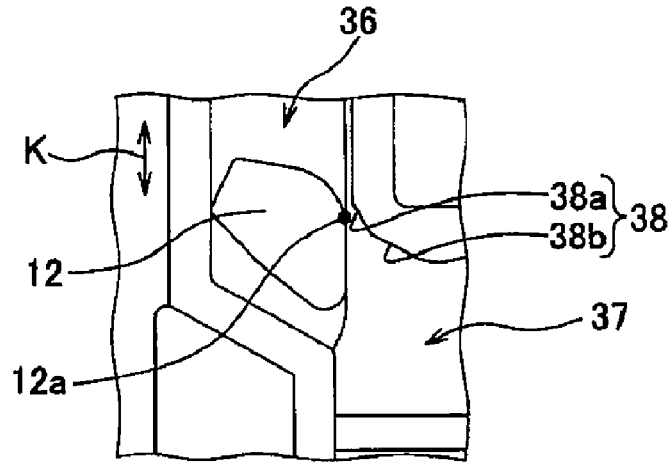
FIG. 15A is an enlarged view of the pivot projection in the lever engaging type connector as shown in FIG. 10.
Figure 15B:
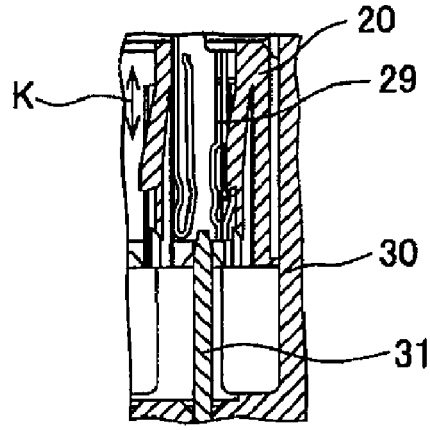
FIG. 15B is a sectional view showing the positional relation between the terminals in the lever engaging type connector as shown in FIG. 15A.
Figure 15C:
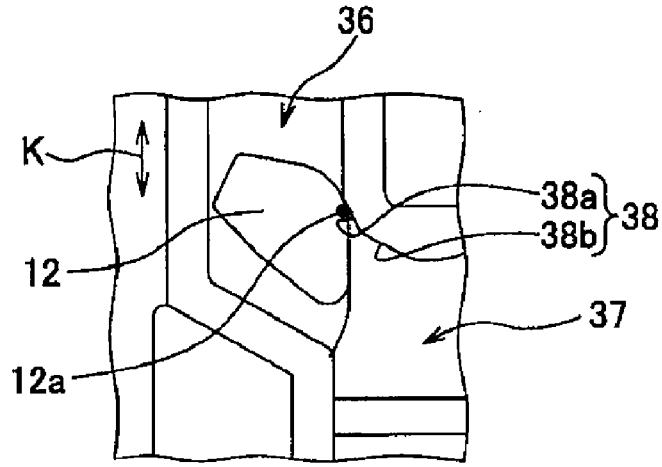
FIG. 15C is an explanatory view for explaining the position of the pivot projection when the unrotatable state of the lever has been released in the lever engaging type connector as shown in FIG. 15A.

As the operating part 14 continues to be further pressed, the butting protuberance 13*a* overrides the temporarily locking protuberance 22*b*, as shown in FIGS. 11A and 11B, and the flexible piece 13*b* completely overpasses the taper portion 35*a*, as shown in FIG. 11C. In this manner, the unrotatable state of the lever 1 is released. In this state, the outer edge part 12*a* of the pivot projection 12 positioned most close to the one end side of the lever 1 is positioned below the second taper wall 38*a* in the engaging direction K, as shown in FIG. 15A. In short, the pivot projection 12 is positioned in the pivot projection receiving groove 37. Moreover, the terminals 29 and 31 are not electrically connected to each other, as shown in FIG. 15B. In case where the lever 1 is operated to rotate in this state, the pivot projection 12 will caught by the second taper wall 38*a* and pulled into the pivot projection receiving groove 37, as shown in FIG. 15C. Then, the outer edge part 12*a* comes into contact with the second taper wall 38*a*, and the pivot projection 12 acts as the pivot.

Figure 12A:
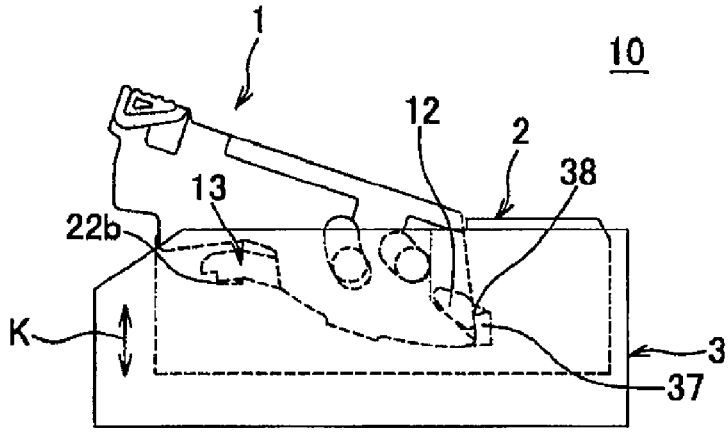
FIG. 12A is a plan view showing a state where the connectors have been temporarily set in the lever engaging type connector as shown in FIG. 11.
Figure 12B:
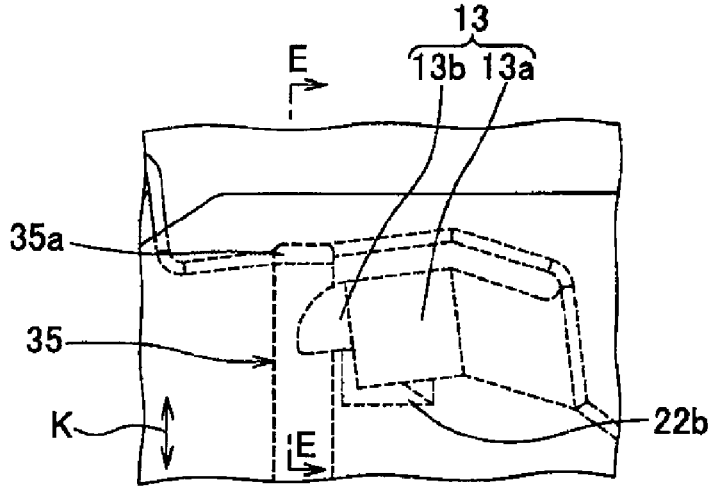
FIG. 12B is an enlarged view of the temporarily locking piece of the lever engaging type connector as shown in FIG. 12A.
Figure 12C:
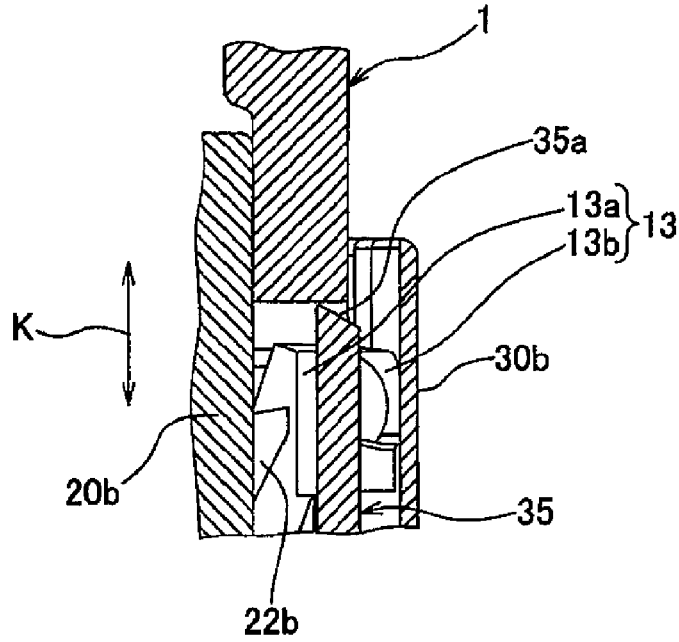
FIG. 12C is a sectional view taken along a line E-E in FIG. 12B.
Figure 13A:
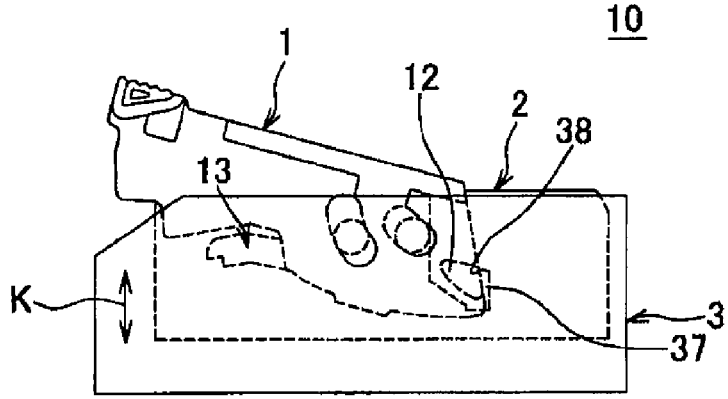
FIG. 13A is a plan view showing a state where the lever has started to rotate in the lever engaging type connector as shown in FIG. 12.
Figure 13B:
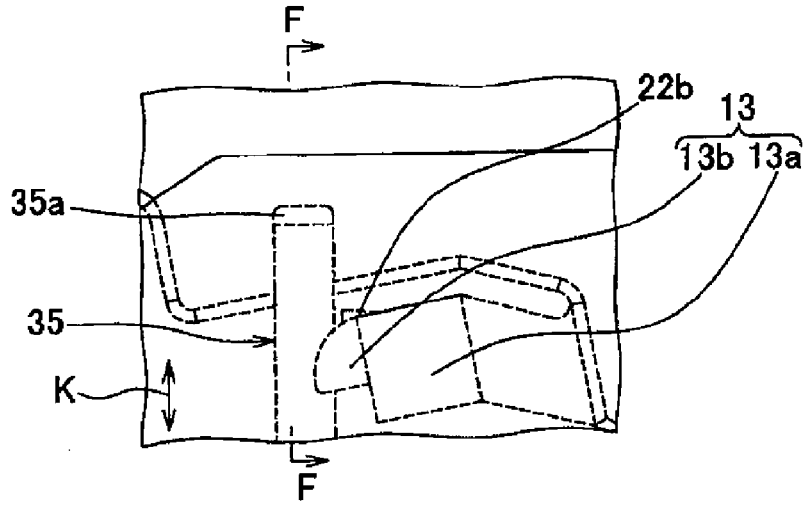
FIG. 13B is an enlarged view of the temporarily locking piece of the lever engaging type connector as shown in FIG. 13A.
Figure 13C:
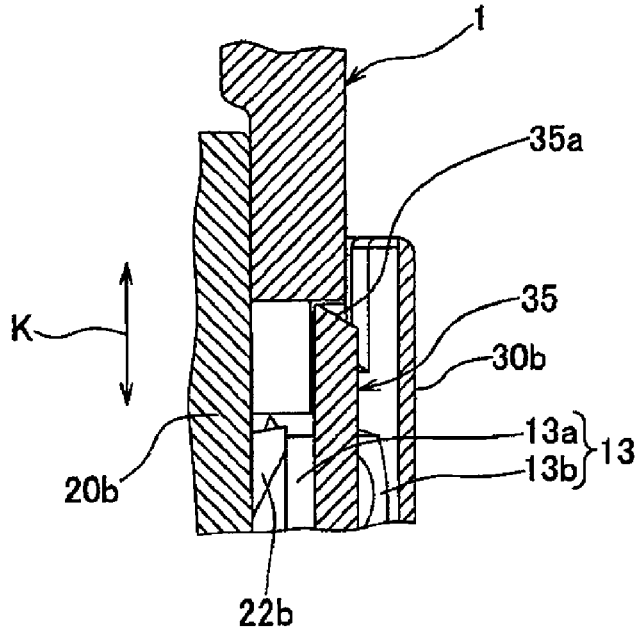
FIG. 13C is a sectional view taken along a line F-F in FIG. 13B.
Figure 16A:
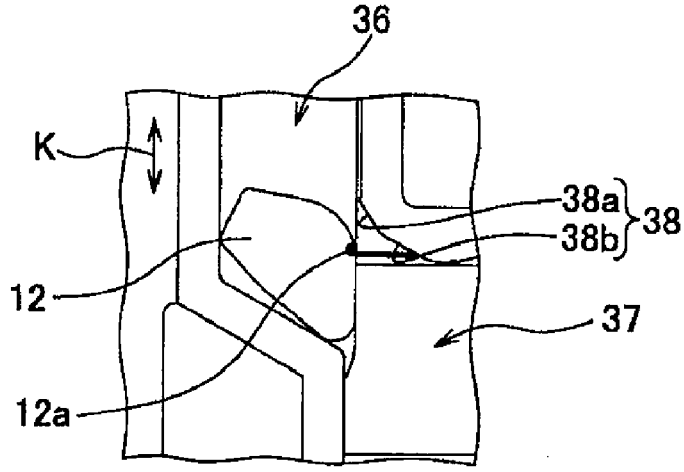
FIG. 16A is an enlarged view of the pivot projection in the lever engaging type connector as shown in FIG. 12.
Figure 16B:
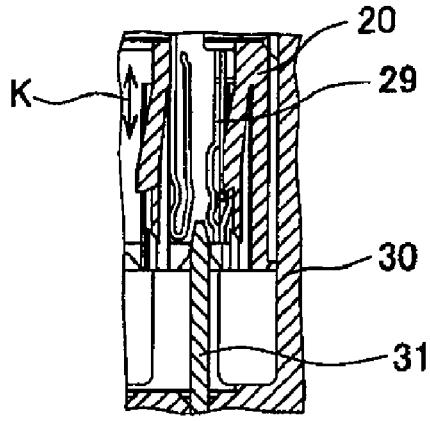
FIG. 16B is a sectional view showing the positional relation between the terminals in the lever engaging type connector as shown in FIG. 16A.
Figure 16C:
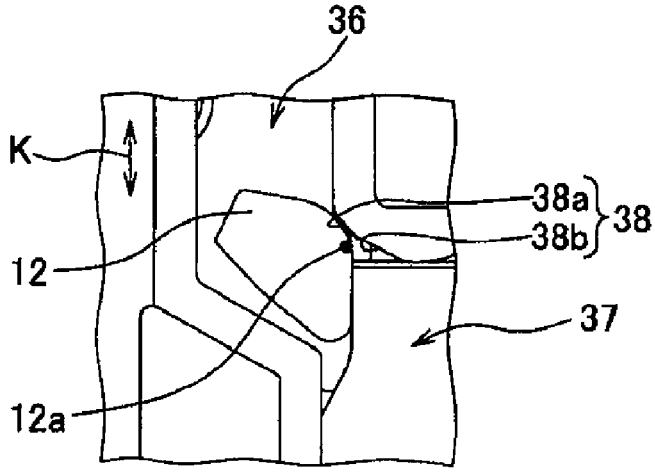
FIG. 16C is an explanatory view for explaining the position of the pivot projection when the lever has been rotated in the lever engaging type connector as shown in FIG. 16A.

Then, the outer edge part 12*a* of the pivot projection 12 positioned most close to the one end side of the lever 1 is positioned below the first taper wall 38*b* in the engaging direction K, as shown in FIGS. 12A and 16A. In short, the pivot projection 12 is positioned in the pivot projection receiving groove 37. This state is expressed as the state where the connectors 2 and 3 have been temporarily set. Moreover, the terminals 29 and 31 are not electrically connected to each other, as shown in FIG. 16B. In case where the lever 1 is operated to rotate in this state, the outer edge part 12*a* of the pivot projection 12 is brought into contact with the first taper wall 38*b*, as shown in FIG. 16C, and the pivot projection 12 acts as the pivot.

Figure 17A:
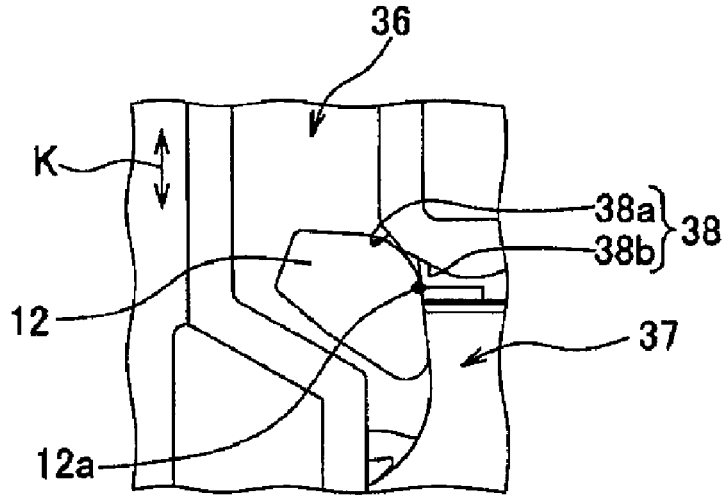
FIG. 17A is an enlarged view of the pivot projection in the lever engaging type connector as shown in FIG. 13.
Figure 17B:
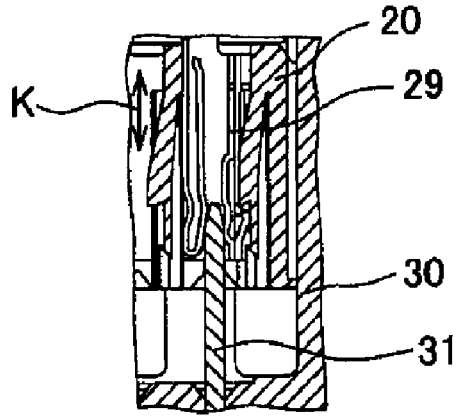
FIG. 17B is a sectional view showing the positional relation between the terminals in the lever engaging type connector as shown in FIG. 17A.

When the lever 1 is started to rotate in this manner, the boss part receiving holes 11*a*, 11*b* act as the point of action of the lever 1, as shown in FIG. 17A, to push the boss parts 21*a*, 21*b* deep into the engaging space 39 along the engaging direction K. As the results, the terminals 31 are engaged with the terminals 29, as shown in FIG. 17B, and electrical connection between the terminals 29, 31 is established.

Further, in the above described lever engaging type connector, when the lever 1 is operated to rotate, after the unrotatable state has been released, it is possible to couple the male connector 2 to the female connector 3 substantially in parallel with each other, in the process where the lever 1 is rotated in the engaging direction, in the state where the pivot projection 12 is positioned in the pivot projection receiving groove 36.

Specifically, in case where the operating part 14 of the lever 1 is operated for the purpose of coupling the male connector 2 to the female connector 3, the thick wall part 40 of the lever 1 presses the upper face of the connector housing 20 at a side opposed to the thick wall part 40. Consequently, the upper face of the connector housing 20 at the side opposed to the operating part 14 moves downward, while the pivot projection (the pivot) of the lever 1 gradually moves upward. In this manner, inclination of the male connector 2 is corrected so that the male connector 2 may become parallel to the female connector 3. As the results, it is possible to make the connectors 2, 3 opposed to each other in parallel, at least when the terminals 29 and the terminals 31 of the respective connectors 2, 3 start to be engaged. In this manner, the engagement between the terminals 29 and the terminals 31 of the connectors 2, 3 can be smoothly and coaxially performed, without applying excessive stress to each other. Moreover, occurrence of a backlash between the male connector 2 and the lever 1 can be prevented, after the male connector 2 has been coupled to the female connector 3.

Therefore, when the male connector 2 is coupled to the female connector 3, by pressing the lever 1 downward in the vertical direction, even though the male connector 2 is inclined with respect to the female connector 3 at initiation of the rotation or in the process of the rotation, the thick wall part 40 of the lever 1 is butted against the arc-shaped face 2*a* of the male connector 2, whereby the lever 1 rapidly presses the male connector 2 downward at the operating part side, while the pivot projection 12 is forcibly moved little by little inside the pivot projection receiving groove 37. In this manner, it is possible to rapidly make the male connector 2 parallel to the female connector 3.

In the above-described embodiment, the case where the thick wall part 40 is provided on the lever 1 at the position opposed to the operating part 14 has been described. In this case, it is possible to make the male connector 2 and the female connector 3 opposed to each other substantially in parallel, while the inclination of the male connector 2 is corrected, particularly in the final stage of the rotation in the process of the rotation of the lever 1. However, the invention is not limited to the case where the thick wall part 40 is provided on the lever 1 at the position opposed to the operating part 14, but the thick wall part 40 may be provided at any position of the face of the lever 1 opposed to the upper face of the connector housing 20 so as to protrude toward the upper face of the connector housing 20. The thickness of the thick wall part 40 and the position to be provided are designed in such a manner that the male connector 2 and the female connector 3 may be opposed to each other in parallel, at least before the contact (engagement) between the terminals 29 and 31 of the connectors 2, 3 starts or nearly starts (including immediately after the contact has started). For this purpose, it would be sufficient that the thick wall part 40 has such a thickness that the lower face of the thick wall part 40 can be contacted with the upper face of the male connector 2, before the terminals 29 formed in the male connector 2 are electrically connected to the terminals 31 formed in the female connector 3 by the pushing operation of the male connector 2 caused by the rotation of the lever 1. Therefore, by increasing the thickness of the thick wall part 40 or providing it near the pivot, it is possible to adjust the timing to make the male connector 2 and the female connector 3 opposed to each other in parallel. According to the lever engaging type connector in the invention, the engagement between the terminals 29 and 31 can be smoothly performed without receiving excessive stress from each other, and the engaged state in tight contact can be maintained, without occurring a backlash. Therefore, an electrically connected state of the terminals 29, 31 is also stabilized.

It is to be noted that the above-described embodiment only shows a representative example of the invention, and the invention is not limited to the embodiment. This means that the invention can be carried out by adding various modifications to the embodiment within a scope not deviating from the gist of the invention.

As herein describe above, in the embodiment according to the invention, the lever 1 is provided with the thick wall part 40 for applying the rotation operating force to the male connector 2, on the face of the lever 1 opposed to the male connector 2, so that the male connector 2 can be engaged with the female connector 3 substantially in parallel, in the process where the lever 1 is rotated or in the final stage of the rotation, in a state where the pivot projection 12 is positioned in the pivot projection receiving groove 37.

Accordingly, by pressing the thick wall part 40 against the upper face of the male connector 2 at the side close to the operating part side while the lever 1 is rotating, the male connector 2 is coupled to the female connector 3 in a manner of correcting the aforesaid floating up (the inclination), that is, so as to be substantially in parallel with each other. As the results, the terminals 29 and 31 of the respective connectors 2 and 3 are smoothly and coaxially engaged with each other, without applying excessive stress to each other. In addition, optimal electrical connection can be established between them, because the terminals 29 and 31 are maintained in the optimal engaged state.

What is claimed is:

1. A lever engaging type connector, comprising:

a male connector;

a lever whose center part is rotatably attached to boss parts on both side faces of the male connector;

a female connector having an engaging space into which the male connector is inserted; and a pivot projection being provided at one end side of the lever;

wherein the lever is rotated by pressing the other end side of the lever toward the female connector, in a state where the pivot projection is positioned in a pivot projection receiving groove which is provided on an inner wall defining the engaging space, thereby enabling the pivot projection to act as a pivot, and the center part to act as a point of action, whereby the male connector is pushed deep into the engaging space along an engaging direction allowing the male connector to be engaged with the female connector;

wherein the pivot projection containing groove is composed of a groove which is continued from an end of a pivot projection guiding groove extending from an upper end of the inner wall deep into the engaging space along the engaging direction, which is remote from the upper end, and extends in a direction intersecting the engaging direction;

the lever and the male connector are provided with temporarily locking means for making the lever unrotatable toward the female connector in an initial stage of engagement;

the inner wall is provided with a releasing plate part in a plate-like shape for releasing an unrotatable state of the lever by the temporarily locking means, as the male connector approaches the female connector, the pivot projection is positioned in the pivot projection receiving groove at a time point when the unrotatable state of the lever has been released, and a thick wall part protruding toward an upper face of the male connector is formed in a part of a lower face of the lever opposed to the upper face of the male connector.

2. The lever engaging type connector as claimed in claim 1, wherein the thick wall part is formed at the other end side of the lower face of the lever opposed to the upper face of the male connector.

3. The lever engaging type connector as claimed in claim 1, wherein the thick wall part has such a thickness that a lower face of the thick wall part can be contacted with the upper face of the male connector, before the terminals formed in the male connector are electrically connected to the terminals formed in the female connector by pushing operation of the male connector caused by the rotation of the lever.

* * * * *